US010012093B2

(12) United States Patent
Mugglestone

(10) Patent No.: US 10,012,093 B2
(45) Date of Patent: Jul. 3, 2018

(54) IMPINGEMENT COOLING OF TURBINE BLADES OR VANES

(71) Applicant: Siemens Aktiengesellschaft, Munich (DE)

(72) Inventor: Jonathan Mugglestone, Brinsley (GB)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 814 days.

(21) Appl. No.: 14/373,861

(22) PCT Filed: Nov. 22, 2012

(86) PCT No.: PCT/EP2012/073352
§ 371 (c)(1),
(2) Date: Jul. 22, 2014

(87) PCT Pub. No.: WO2013/117258
PCT Pub. Date: Aug. 15, 2013

(65) Prior Publication Data

US 2015/0030461 A1 Jan. 29, 2015

(30) Foreign Application Priority Data

Feb. 9, 2012 (EP) ..... 12154722

(51) Int. Cl.
*F01D 5/18* (2006.01)
*F01D 9/06* (2006.01)

(52) U.S. Cl.
CPC ..... *F01D 5/188* (2013.01); *F01D 5/186* (2013.01); *F01D 9/065* (2013.01);
(Continued)

(58) Field of Classification Search
CPC ..... F01D 5/187; F01D 5/188; F01D 5/189; F01D 9/02; F01D 9/065; F05D 2260/201
(Continued)

(56) References Cited

U.S. PATENT DOCUMENTS 3,540,810 A 11/1970 Kercher
3,628,880 A * 12/1971 Smuland ..... F01D 5/189 415/115

(Continued)

FOREIGN PATENT DOCUMENTS

CN 102224322 A 10/2011
DE 3033770 A1 4/1981

(Continued)

OTHER PUBLICATIONS

JP Notice of Allowance dated Sep. 12, 2016, for JP application No. 2014555952.

*Primary Examiner* — Sean J Younger
(74) *Attorney, Agent, or Firm* — Beusse Wolter Sanks & Maire

(57) ABSTRACT

A turbine assembly is provided having a hollow aerofoil having a cavity with an impingement tube insertable inside the cavity and used for impingement cooling of an inner surface of the cavity, and a platform arranged at a radial end of the hollow aerofoil, and a cooling chamber used for cooling of the platform which is arranged relative to the hollow aerofoil on an opposed side of the platform. The cooling chamber is limited at a first radial end from the platform and at an opposed radial second end from a cover plate. The impingement tube is formed from a leading piece and a trailing piece. The leading piece extends in span wise direction at least completely through the cooling chamber from the platform to the cover plate and the trailing piece terminates in span wise direction at the platform.

17 Claims, 4 Drawing Sheets

(52) U.S. Cl.
CPC ..... *F05D 2220/31* (2013.01); *F05D 2240/81* (2013.01); *F05D 2260/201* (2013.01); *F05D 2260/205* (2013.01)

(58) Field of Classification Search
USPC ..... 415/115
See application file for complete search history.

(56) References Cited

U.S. PATENT DOCUMENTS

| | | | | | |
|---|---|---|---|---|---|
| 3,891,348 | A * | 6/1975 | Auxier | F01D 5/189 | 416/96 A |
| 4,252,501 | A * | 2/1981 | Peill | F01D 5/189 | 415/115 |
| 5,120,192 | A * | 6/1992 | Ohtomo | F01D 5/189 | 415/115 |
| 5,207,556 | A | 5/1993 | Frederick et al. | | |
| 5,320,485 | A | 6/1994 | Boury | | |
| 5,591,002 | A * | 1/1997 | Cunha | F01D 5/187 | 415/115 |
| 5,630,700 | A | 5/1997 | Blair | | |
| 5,645,397 | A | 7/1997 | Hall | | |
| 5,743,708 | A | 4/1998 | Brown | | |
| 5,829,245 | A * | 11/1998 | McQuiggan | F01D 5/187 | 415/114 |
| 5,954,475 | A | 9/1999 | Matsuura | | |
| 6,019,572 | A | 2/2000 | Cunha | | |
| 6,089,822 | A * | 7/2000 | Fukuno | F01D 5/189 | 415/115 |
| 6,142,730 | A | 11/2000 | Arase | | |
| 6,283,708 | B1 * | 9/2001 | Zelesky | F01D 5/189 | 416/97 R |
| 6,315,518 | B1 * | 11/2001 | Uematsu | F01D 5/186 | 415/115 |
| 6,416,275 | B1 * | 7/2002 | Itzel | F01D 5/189 | 415/116 |
| 6,561,757 | B2 * | 5/2003 | Burdgick | F01D 5/186 | 415/114 |
| 7,921,654 | B1 * | 4/2011 | Liang | F01D 5/186 | 415/115 |
| 8,662,844 | B2 | 3/2014 | Hada et al. | | |
| 2004/0170499 | A1 | 9/2004 | Powis et al. | | |
| 2011/0123351 | A1 | 5/2011 | Hada | | |

FOREIGN PATENT DOCUMENTS

| | | | |
|---|---|---|---|
| EP | 0531202 | A1 | 3/1993 |
| EP | 0911486 | A2 | 4/1999 |
| EP | 0926313 | A1 | 6/1999 |
| EP | 0926313 | B1 | 10/2003 |
| EP | 1452689 | A1 | 9/2004 |
| GB | 1322801 | A | 7/1973 |
| JP | S4826086 | B1 | 8/1973 |
| JP | S4826086 | B1 | 9/1973 |
| JP | H06010704 | A | 1/1994 |
| JP | H11132005 | A | 5/1999 |
| JP | 2004257392 | A | 9/2004 |
| JP | 2011043118 | A | 3/2011 |
| JP | 5107463 | B2 | 12/2012 |
| RU | 2056505 | C1 | 3/1996 |
| RU | 2267616 | C1 | 1/2006 |
| WO | 2010/131385 | A1 | 11/2010 |
| WO | 2010131385 | A1 | 11/2010 |

* cited by examiner

IMPINGEMENT COOLING OF TURBINE BLADES OR VANES

CROSS REFERENCE TO RELATED APPLICATIONS

This application is the US National Stage of International Application No. PCT/EP2012/073352 filed Nov. 22, 2012, and claims the benefit thereof. The International Application claims the benefit of European Application No. EP12154722 filed Feb. 9, 2012. All of the applications are incorporated by reference herein in their entirety.

FIELD OF THE INVENTION

The present invention relates to an aerofoil-shaped turbine assembly such as turbine rotor blades and stator vanes.

BACKGROUND TO THE INVENTION

Modern turbines often operate at extremely high temperatures. The effect of temperature on the turbine blades and/or stator vanes can be detrimental to the efficient operation of the turbine and can, in extreme circumstances, lead to distortion and possible failure of the blade or vane. In order to overcome this risk, high temperature turbines may include hollow blades or vanes incorporating so-called impingement tubes for cooling purposes.

These so-called impingement tubes are hollow tubes that run radially within the blades or vanes. Air is forced into and along these tubes and emerges through suitable apertures into a void between the tubes and interior surfaces of the hollow blades or vanes. This creates an internal air flow for cooling the blade or vane.

Normally, blades and vanes are made as precision castings having hollow structures in which impingement tubes are inserted for impingement cooling of an impingement cooling zone of the hollow structure. Problems arise when a cooling concept is used in which a temperature of a cooling medium for the impingement cooling zone is too high for efficient cooling of the latter.

This is known from a cooling concept, where a combined platform and aerofoil cooling systems are arranged in series. A compressor discharge flow feeds in the platform cooling and then passes into the aerofoil cooling system.

SUMMARY OF INVENTION

It is a first objective of the present invention to provide an advantageous aerofoil-shaped turbine assembly such as a turbine rotor blade and a stator vane. A second objective of the invention is to provide an advantageous impingement tube used in such an assembly for cooling purposes. A third objective of the invention is to provide a gas turbine engine comprising at least one advantageous turbine assembly.

Accordingly, the present invention provides a turbine assembly comprising a basically hollow aerofoil having at least a cavity with at least an impingement tube, which is insertable inside the cavity of the hollow aerofoil and is used for impingement cooling of at least an inner surface of the cavity, and with at least a platform, which is arranged at a radial end of the hollow aerofoil, and with at least a cooling chamber used for cooling of at least the platform and which is arranged relative to the hollow aerofoil on an opposed side of the platform and wherein the cooling chamber is limited at a first radial end from the platform and at an opposed radial second end from at least a cover plate.

It is provided that the impingement tube is being formed from a leading piece and a trailing piece, wherein the leading piece is located towards a leading edge of the hollow aerofoil and the trailing piece is located viewed in direction from the leading edge to the trailing edge downstream of the leading piece and wherein the leading piece of the impingement tube extends in span wise direction at least completely through the cooling chamber from the platform to the cover plate and wherein the trailing piece of the impingement tube terminates in span wise direction at the platform.

Due to the inventive matter both a compressor discharge flow and a platform cooling flow is fed into the aerofoil. This allows a significant improvement in aerofoil cooling efficiency while minimising performance losses. Specifically, in comparison to state of the art systems lower cooling feed temperatures and reduced cooling flows can be achieved. Moreover, also the cooling efficiency of a pedestal region in a trailing edge region could be improved, since heat transfer coefficients can be maximised through high rates resulting from combined cooling flows. Further, an aerofoil and a platform cooling can be adjusted independently, providing good control of both cooling systems. Additionally, aerodynamic/performance losses can be minimised. With the use of such a turbine assembly, conventional state of the art precision castings of rotor blades and stator vanes could be used. Hence, intricate and costly reconstruction of these aerofoils and changes to a casting process could be omitted. Consequently, an efficient turbine assembly or turbine, respectively, could advantageously be provided.

A turbine assembly is intended to mean an assembly provided for a turbine, like a gas turbine, wherein the assembly possesses at least an aerofoil. Preferably, the turbine assembly has a turbine cascade and/or wheel with circumferential arranged aerofoils and/or an outer and an inner platform arranged at opponent ends of the aerofoil(s). In this context a "basically hollow aerofoil" means an aerofoil with a casing, wherein the casing encases at least one cavity. A structure, like a rib, rail or partition, which divides different cavities in the aerofoil from one another and for example extends in a span wise direction of the aerofoil, does not hinder the definition of "a basically hollow aerofoil". Preferably, the aerofoil is hollow. In particular, the basically hollow aerofoil, referred as aerofoil in the following description, has two cooling regions, an impingement cooling region at a leading edge of the aerofoil and a state of the art pin-fin/pedestal cooling region at the trailing edge. These regions could be separated from one another through a rib.

In this context an impingement tube is a piece that is constructed independently from the aerofoil and/or is another piece then the aerofoil and/or isn't formed integrally with the aerofoil. The phrase "which is insertable inside the cavity of the hollow aerofoil" is intended to mean that the impingement tube is inserted into the cavity of the aerofoil during an assembly process of the turbine assembly, especially as a separate piece from the aerofoil. Moreover, the phrase "is used for impingement cooling" is intended to mean that the impingement tube is intended, primed, designed and/or embodied to mediate a cooling via an impingement process. An inner surface of the cavity defines in particular a surface which faces an outer surface of the impingement tube.

A platform is intended to mean a region of the turbine assembly which confines at least a part of a cavity and in particular, a cavity of the aerofoil. Moreover, the platform is arranged at a radial end of the hollow aerofoil, wherein a radial end defines an end which is arranged with a radial distance from an axis of rotation of the turbine assembly or a spindle, respectively. The platform could be a region of the casing of the aerofoil or a separate piece attached to the aerofoil. The platform may be an inner platform and/or an outer platform and is preferably the outer platform. Furthermore, the platform is oriented basically perpendicular to a span wise direction of the hollow aerofoil. In the scope of an arrangement of the platform as "basically perpendicular" to a span wise direction should also lie a divergence of the platform in respect to the span wise direction of about 45°. Preferably, the platform is arranged perpendicular to the span wise direction. A span wise direction of the hollow aerofoil is defined as a direction extending basically perpendicular, preferably perpendicular, to a direction from the leading edge to the trailing edge of the aerofoil, the latter direction is also known as a chord wise direction of the hollow aerofoil. In the following text this direction is referred to as the axial direction.

A cooling chamber is intended to mean a cavity in that cooling medium may be fed, stored and/or induced for the purpose of cooling of side walls of the cavity and especially of a platform. In this context a cover plate is intended to mean a plate, a lid, a top or any other device suitable for a person skilled in the art, which basically covers the cooling chamber. The term "basically covers" is intended to mean that the cover plate does not hermetically seals the cooling chamber. Thus, the cover plate may have holes to provide access for the cooling medium into the cooling chamber. Preferably, the cover plate is an impingement plate. The term "limit" should be understood as "border", "terminate" or "confine". In other words the platform and the cover plate borders the cooling chamber.

A piece of the impingement tube defines a part of the impingement tube which is supplied from an exterior of the impingement tube with cooling medium in an independent way in respect to another piece of the impingement tube. A supply of cooling medium from one piece to another piece through at least a connecting aperture between the pieces of the impingement tube does not hinder the definition of "independent".

Advantageously, the hollow aerofoil comprises a single cavity. But the invention could also be realized for a hollow aerofoil comprising two or more cavities each of them accommodating an impingement tube according to the invention and/or being a part of the pin-fin/pedestal cooling region.

As stated above, the hollow aerofoil comprises a trailing edge and a leading edge with the leading piece is located towards the leading edge of the hollow aerofoil and the trailing piece is located viewed in direction from the leading edge to the trailing edge downstream of the leading piece. This results in an efficient cooling of this region and advantageously in minimised aerofoil cooling feed temperatures in respect to state of the art systems. The low temperature compressor discharge flow is fed directly to the aerofoil leading edge region where the highest cooling effectiveness is required. Due to the thus increased impingement cooling effectiveness throughout the entire impingement region and at the leading edge, less cooling flow will be required compared to state of the art systems. In addition to the performance benefits, this reduction in cooling flow within the leading edge region has the effect of increasing the cooling effectiveness on the downstream impingement regions due to the reduced cross flow effects.

Further, as the leading piece is located towards the leading edge of the hollow aerofoil and the trailing piece is located viewed in direction from the leading edge to the trailing edge downstream of the leading piece or in other words located more towards the trailing edge of the hollow aerofoil than the leading piece, thus, the platform cooling flow is directed to provide impingement cooling at the more downstream regions of the aerofoil.

The leading piece and the trailing piece are provided with impingement holes. Consequently, a merged stream of cooling medium from the cooling chamber, from the leading piece and from the trailing piece may pass through the non-impingement pin-fin/pedestal cooling region. The heat transfer coefficients within the pin-fin/pedestal cooling region are advantageously maximised because of the high combined flow rates. Potentially, the merged stream can exit through the aerofoil trailing edge. Therefore, the trailing edge has exit apertures to allow the merged stream to exit the hollow aerofoil. Due to this a most effective ejection can be provided. Hence, the aerodynamic/performance losses can be minimised in respect to state of the art systems. In these systems a cooling of the platform and the aerofoil is performed independently from each other with no flow connection between the platform and the aerofoil. For a discharge of the cooling medium these systems need additional exit apertures near the platform which results in discharge of more cooling medium, especially in a less efficient manner in respect to the inventive construction. Thus, high losses can arise with such state of the art cooling ejection near the platform.

In an advantageous embodiment the leading piece of the impingement tube ends at the cover plate in a hermetically sealed manner. Thus, a leakage between the leading piece of the impingement tube and the cooling chamber is efficiently prevented. The term "end" should be understood as "finish" or "stop". Preferably, the impingement tube or the leading and the trailing piece, respectively, extends substantially completely through a span of the hollow aerofoil resulting in a powerful cooling of the aerofoil. But it is also conceivable that at least one of the leading and the trailing piece would extend only through a part of the span of the hollow aerofoil.

As stated above, the impingement tube being formed from at least two separate pieces, the leading and the trailing piece, with the leading piece is located towards the leading edge of the hollow aerofoil and the trailing piece is located viewed in direction from the leading edge to the trailing edge downstream of the leading piece. To use a two or more piece impingement tube allows characteristics of the pieces, like material, material thickness or any other characteristic suitable for a person skilled in the art, to be customised to the cooling function of the piece. Through this advantageous arrangement the leading piece and thus the fresh unheated compressor discharge flow is efficiently used for the direct cooling of the leading edge—the region of the aerofoil where the highest cooling effectiveness is required.

But it is also conceivable that the impingement tube being formed from three separate pieces, particularly as a leading, a middle and a trailing piece of the impingement tube, wherein the leading piece, which extends in span wise direction at least completely through the cooling chamber from the platform to the cover plate, could be located towards the leading edge of the hollow aerofoil, the middle piece could be located in a middle of the hollow aerofoil or the cavity thereof, respectively, and/or the trailing piece could be located towards a trailing edge of the hollow aerofoil.

Advantageously, each of the at least two separate pieces extends substantially completely through the span of the hollow aerofoil resulting in an effective cooling of the aerofoil. But it is also conceivable that at least one of the at least two separate pieces would extend only through a part of the span of the hollow aerofoil.

Furthermore, it is advantageous when the turbine assembly possesses at least a further platform. The features described in this text for the first mentioned platform could be also applied to the at least further platform. The platform and the at least further platform are arranged at opposed radial ends of the hollow aerofoil. Moreover, the leading and the trailing piece of the impingement tube both may terminate at the at least further platform. Due to this, the cooling chamber or an at least further cooling chamber of the at least further platform can be realised as an unblocked space, hence a velocity of a cross flow of used impingement cooling medium could be maintained low and the impingement cooling may be more effective in comparison with a blocked cooling chamber. Further, the proper arrangement of the pieces inside the aerofoil during assembly can be ensured.

Particularly, the leading piece and the trailing piece of the impingement tube both terminate in radial direction flush with each other. In this context "flush with each other" is intended to mean, that the pieces end at the same radial height of the turbine assembly and/or the aerofoil and/or the at least further platform.

Thereby the leading piece and the trailing piece may extend through the at least further platform to provide a flow communication between the pieces and the at least further cooling chamber. Alternatively, the leading piece and the trailing piece may be sealed hermetically by the at least further platform. In the latter case the cooling chamber or the at least further cooling chamber may be provided with at least an exit aperture for the cooling medium to exit the cooling chamber or the at least further cooling chamber.

Moreover, the at least further cooling chamber of the at least further platform is used for cooling the latter and is arranged relative to the hollow aerofoil on an opposed side of the at least further platform and wherein the at least further cooling chamber is limited at a first radial end from the at least further platform and at the opposed radial second end from at least a further cover plate.

Preferably, the leading piece of the impingement tube is sealed in respect to the at least further cooling chamber. Due to this, the compressor discharge flow entering the leading piece from the side of the platform is unhindered by a contrariwise flow of cooling medium, entering from the leading piece from the side of the at least further platform. The at least further platform covers the leading piece in a hermetically sealed manner, thus saving an additional sealing means. The trailing piece has at its second radial end at the at least further platform an aperture for a flow communication with the at least further cooling chamber. Hence, sufficient cooling medium could be fed to the trailing piece.

Alternatively, it may be possible, that the leading piece extends in span wise direction at least completely through the at least further cooling chamber from the at least further platform to the at least further cover plate, hence ensuring a sufficient feed of cooling medium into the leading piece. Further, the leading piece of the impingement tube could end both at the cover plate and at the at least further cover plate in a hermetically sealed manner, providing a leakage free feeding of cooling medium.

In an alternative embodiment the leading piece and the trailing piece of the impingement tube have corresponding apertures to allow a flow communication of cooling medium between the leading piece and the trailing piece. Due to this construction, a bypass could be provided, by means of which a fraction of the cooling medium may avoid to eject through the impingement holes of the leading piece. Hence, cooling medium with a low temperature can enter the trailing piece for efficient cooling of the latter.

To provide the turbine assembly with good cooling properties and a satisfactory alignment of the impingement tube in the aerofoil, the hollow aerofoil comprises at least a spacer at the inner surface of the cavity of the hollow aerofoil to hold the impingement tube at a predetermined distance to said surface of the hollow aerofoil. The spacer is preferably embodied as a protrusion or a locking pin or a rib for easy construction and a straight seat of the impingement tube.

In a further advantageous embodiment the hollow aerofoil is a turbine blade or vane, for example a nozzle guide vane.

In an alternative or further embodiment one cover plate and/or one cooling chamber may feed more than one aerofoil i.e. the stator vanes are constructed as segments comprising e g two or more aerofoils.

According to the inventive embodiment the turbine assembly is being cooled by a first stream of cooling medium which is fed to the leading piece of the impingement tube and by a second stream of cooling medium which is fed first to the cooling chamber and second to the trailing piece of the impingement tube in series. Advantageously, this results in minimised aerofoil cooling feed temperatures and thus in a higher impingement cooling effectiveness throughout the entire impingement region compared to state of the art systems. The first stream is preferably taken directly from the compressor discharge flow and the second stream the spent platform cooling flow. The term "in series" is intended to mean that the second stream passes the cooling chamber and the trailing piece specially and/or chronologically one after the other.

Further, the turbine assembly is used for cooling of the basically hollow aerofoil, wherein the first stream of cooling medium is directly fed to the leading piece of the impingement tube and the second stream of the cooling medium is fed to the cooling chamber and/or the at least further cooling chamber and thereafter to the trailing piece of the impingement tube in series.

Moreover, the leading piece and the trailing piece are arranged side by side in axial direction, especially, directly side by side in axial direction. Hence, different and customised cooling features could be provided for the leading edge and the region oriented toward the trailing edge of the impingement region of the aerofoil in the inserted state of the impingement tube.

Furthermore, the invention is directed to a gas turbine engine comprising a plurality of turbine assemblies, wherein at least one or all of the turbine assemblies are arranged such as explained before.

The above-described characteristics, features and advantages of this invention and the manner in which they are achieved are clear and clearly understood in connection with the following description of exemplary embodiments which are explained in connection with the drawings.

BRIEF DESCRIPTION OF THE DRAWINGS

The present invention will be described with reference to drawings in which.

DETAILED DESCRIPTION OF THE ILLUSTRATED EMBODIMENTS

In the present description, reference will only be made to a vane, for the sake of simplicity, but it is to be understood that the invention is applicable to both blades and vanes of a turbine.

Figure 1:
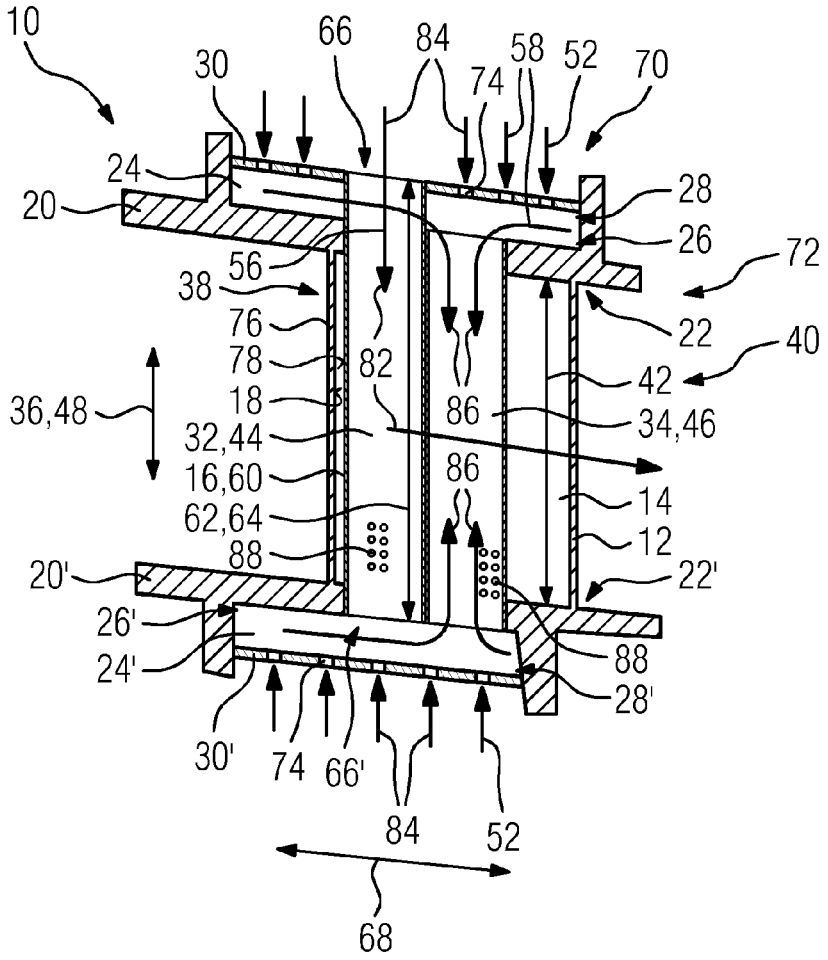
FIG. 1: shows a cross section through an turbine assembly with an inserted impingement tube being formed from two pieces.

FIG. 1 shows in a cross section a turbine assembly 10. The turbine assembly 10 comprises a basically hollow aerofoil 12, embodied as a vane, with two cooling regions, specifically, an impingement cooling region 70 and a pin-fin/pedestal cooling region 72. The former is located at a leading edge 38 and the latter at a trailing edge 40 of the aerofoil 12. At two radial ends 22, 22' of the hollow aerofoil 12, which are arranged opposed towards each other at the aerofoil 12, a platform and a further platform, referred to in the following text as an outer platform 20 and an inner platform 20', are arranged. The outer platform 20 and the inner platform 20' are oriented perpendicular to a span wise direction 36 of the hollow aerofoil 12. In a circumferential direction of a not shown turbine cascade several aerofoils 12 could be arranged, wherein all aerofoils 12 where connected through the outer and the inner platforms 20, 20' with one another.

Moreover, the cooling assembly 10 comprises cooling chambers referred in the following text as first cooling chamber 24 and a further second cooling chamber 24'. The first and second cooling chambers 24, 24' are used for cooling of the outer and the inner platforms 20, 20' and are arranged relative to the hollow aerofoil 12 on opposed sides of the outer and the inner platforms 20, 20'. Both cooling chambers 24, 24' are limited at a first radial end 26, 26' by the outer or the inner platform 20, 20' and at an opposed radial second end 28, 28' by a cover plate, referred in the following text as first cover plate 30 and a further second cover plate 30'. The first and second cover plates 30, 30' are embodied as impingement plates and have impingement holes 74 to provide access for a cooling medium 52 into the first and second cooling chambers 24, 24'.

A casing 76 of the hollow aerofoil 12 forms a cavity 14 in the impingement cooling region 70. Arranged inside the cavity 14 is an impingement tube 16, which is inserted into the cavity 14 during assembly of the turbine assembly 10. The impingement tube 16 is used for impingement cooling of an inner surface 18 of the cavity 14, wherein the inner surface 18 faces an outer surface 78 of the impingement tube 16. The impingement tube 16 has a first section 32 and a second section 34, wherein the first and the second sections 32, 34 are built from separate pieces 44, 46, so that the impingement tube 16 is formed from two separate pieces 44, 46, namely a leading piece 44 and a trailing piece 46. Alternatively, the first and the second sections may be constructed from a single piece tube with a dividing wall (see FIG. 3). In the following text the terms first section 32 or leading piece 44 and second section 34 or trailing piece 46, respectively, are used equivalent to each other.

"Piece" in respect of the invention may be a complete impingement tube with all walls present. It may particularly not be a construction that a single impingement tube will be assembled from parts, e.g. by assembling four walls to a single impingement tube. A piece, according to the invention, may be a complete tube.

The base body 60 extends with its longitudinal extension 62 (span wise extension) in a radial direction 48 of the aerofoil 12. Further, the impingement tube 16 or the first section 32 and the second section 34, respectively, extend in span wise direction 36 completely through a span 42 of the hollow aerofoil 12 and the first section 32 has a greater length 64 in radial direction 48 than the second section 34. At the inner surface 18 of the hollow aerofoil 12 the latter comprises a number of spacers 80 to hold the impingement tube 16 at a predetermined distance to this surface 18. The spacers 80 are embodied as protrusions or ribs, which extend perpendicular to the span wise direction 36 (see FIG. 2, spacers are shown in a top view).

Figure 2:
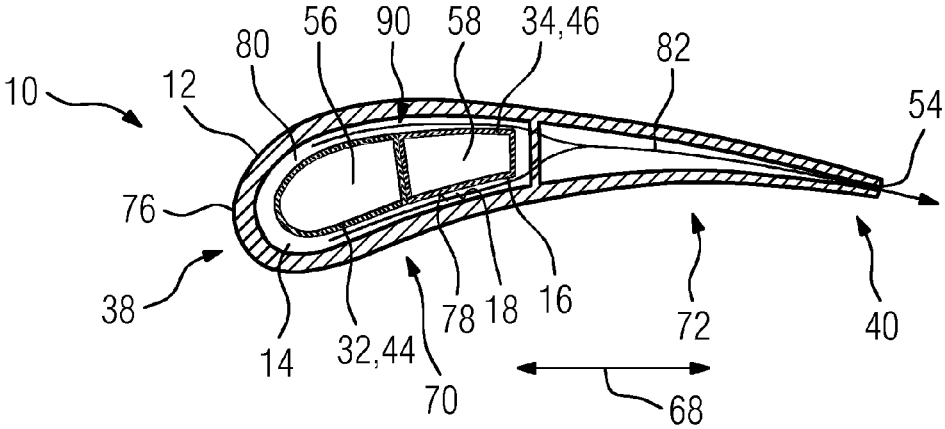
FIG. 2: shows a cross section through the aerofoil with the inserted impingement tube along line II-II in FIG. 1, FIG. 3: shows a perspective view of an alternative impingement tube being formed as a one piece part.

The first section 32 and the second section 34 are arranged side by side in axial direction 68 or chord wise direction of the base body 60 or the aerofoil 12, respectively. As can be seen in FIG. 2, which shows a cross section through the aerofoil 12 with the inserted impingement tube 16, the leading piece 44 is located towards or more precisely at the leading edge 38 and the trailing piece 46 is located viewed in axial direction 68 downstream of the leading piece 44 or more towards the trailing edge 40 than the leading piece 44.

The first section 32 of the impingement tube 16 extends in span wise direction 36 completely through the cooling chamber 24 from the outer platform 20 to the first cover plate 30. Moreover, the first section 32 of the impingement tube 16 ends at its first radial or longitudinal end 66 at the first cover plate 30 in a hermetically sealed manner, thus preventing a leakage of cooling medium 52 from the first section 32 into the first cooling chamber 24. The first section 32 and the second section 34 of the impingement tube 16 both extend through the inner platform 20' and terminate at their second radial or longitudinal ends 66' at the inner platform 20' and specifically in radial direction 48 flush with each other. The radial direction 48 is defined in respect to an axis of rotation of a not shown spindle arranged in a known way in the turbine assembly 10. The second radial or longitudinal end 66' of the first section 32 is sealed via a sealing means, like a lit, in respect to the second cooling chamber 24'.

During an operation of the turbine assembly 10 the impingement tube 16 provides a flow path 82 for the cooling medium 52, for example air. A compressor discharge flow 84 from a not shown compressor is fed to the first section 32 of the impingement tube 16 and via the impingement holes 74 of the first and second cover plate 30, 30' into the first and second cooling chambers 24, 24'. Cooling medium 52 from the first and second cooling chambers 24, 24' is then as a platform cooling flow 86 discharged into the second section 34 of the impingement tube 16. Thus, the turbine assembly 10 is being cooled by a first stream 56 of cooling medium 52 which is fed to the first section 32 of the impingement tube 16 and by a second stream 58 of cooling medium 52 which is fed first to the first and second cooling chambers 24, 24' and thereafter to the second section 34 of the impingement tube 16 in series.

Figure 3:
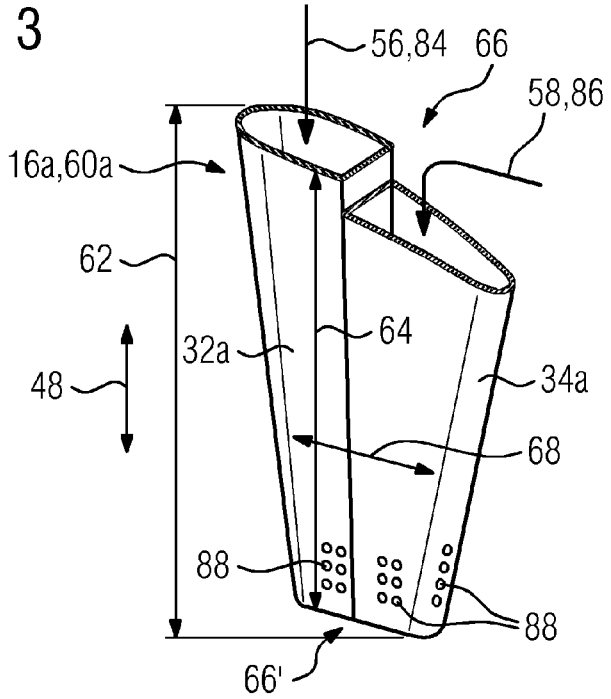
Figure 4:
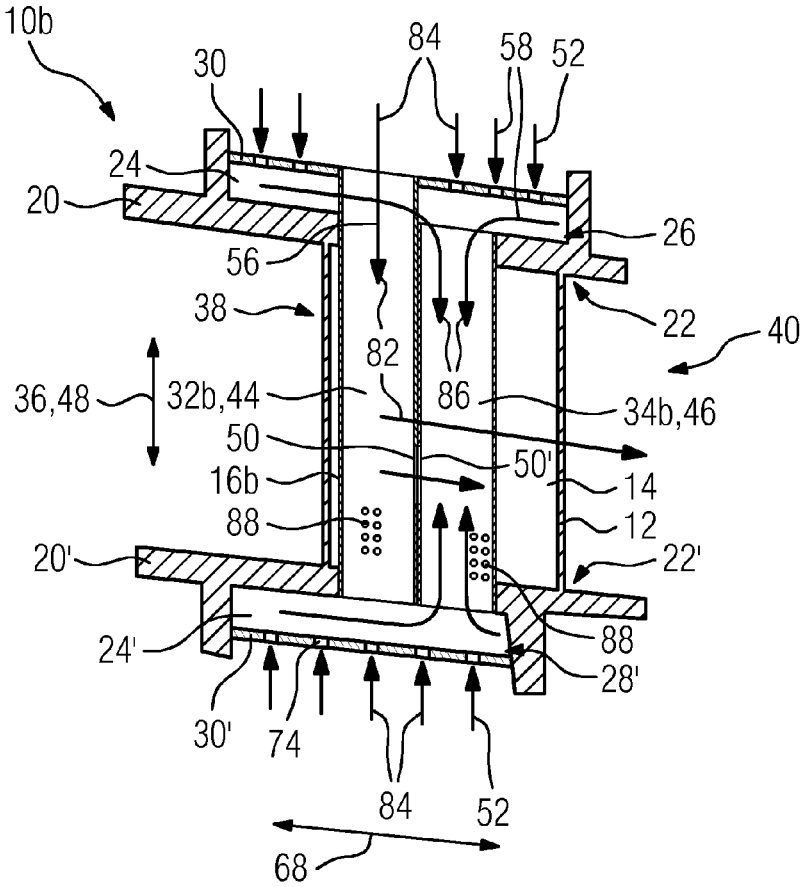
FIG. 4: shows a cross section through an alternative turbine assembly with a further alternatively embodied impingement tube.

For ejection of the cooling medium 52 from the first and second sections 32, 34 to cool the inner surface 18 of the cavity 14 the first and second sections 32, 34 comprise impingement holes 88 (only partially shown in FIGS. 2 to 4). The ejected streams of cooling medium 52 indirectly from the cooling chamber 24, 24' and directly from the first section 32 as well as directly from the second section 34 merge in a space 90 between the outer surface 78 of the impingement tube 16 and the inner surface 18 of the cavity 14. This merged stream flows to the pin-fin/pedestal cooling region 72 located at the trailing edge 40 and exits the hollow aerofoil 12 through exit apertures 54 in the trailing edge 40 (see FIG. 2).

In FIGS. 3 to 8 alternative embodiments of the impingement tube 16 and the turbine assembly 10 are shown. Components, features and functions that remain identical are in principle substantially denoted by the same reference characters. To distinguish between the embodiments, however, the letters "a" to "f" has been added to the different reference characters of the embodiment in FIGS. 3 to 8. The following description is confined substantially to the differences from the embodiment in FIGS. 1 and 2, wherein with regard to components, features and functions that remain identical reference may be made to the description of the embodiment in FIGS. 1 and 2.

FIG. 3 shows an impingement tube 16*a* with a base body 60*a* for insertion within a cavity of a basically hollow aerofoil of a not in detail shown turbine assembly for impingement cooling of an inner surface of the cavity. A first section 32*a* and a second section 34*a* of the impingement tube 16*a* are formed integrally with each other or are moulded out of one piece and are separated via a dividing wall or a dividing wall insert. In the inserted state of the impingement tube 16*a* in the cavity the base body 60*a* extends with its longitudinal extension 62 (span wise extension) in a radial direction 48 of the hollow aerofoil (not shown, but refer to FIG. 1). The first section 32*a* and the second section 34*a* are arranged side by side in axial direction 68 of the base body 60*a* or the aerofoil, respectively. The first section 32*a* has a greater length 64 in radial direction 48 than the second section 34*a*. Further, the first section 32*a* and the second section 34*a* terminate at a radial or longitudinal end 66' of the base body 60*a* flush with each other. Thus, the base body 60*a* differs in the construction of the radial or longitudinal ends 66, 66' of the first and second sections 32*a*, 34*a*.

FIG. 4 shows a cross section through a turbine assembly 10*b* analogously formed as in FIGS. 1 and 2 with an alternatively embodied impingement tube 16*b*. The embodiment from FIG. 4 differs in regard to the embodiment according to FIGS. 1 and 2 in that a first section 32*b* and the second section 34*b* of the impingement tube 16*b* have corresponding apertures 50, 50' to allow a flow communication of cooling medium 52 between the first section 32*b* and the second section 34*b*. Thus, a bypass could be provided, by means of which a fraction of the first stream 56 of the cooling medium 52 avoids to eject through impingement holes 88 of the first section 32*b*.

Figure 5:
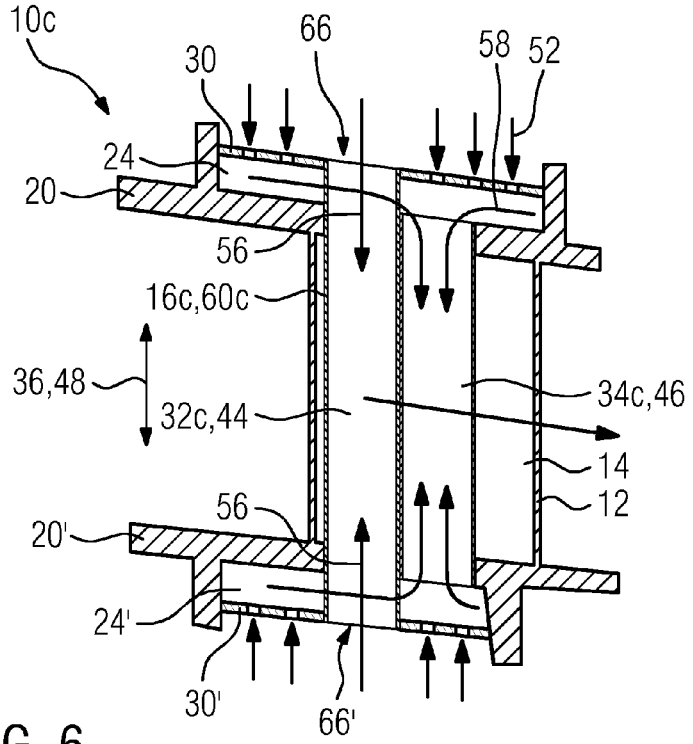
FIG. 5: shows a cross section through a second alternative turbine assembly with a further alternatively embodied impingement tube.

In FIG. 5 a cross section through a turbine assembly 10*c* analogously formed as in FIGS. 1 and 2 with an alternatively embodied impingement tube 16*c* is shown. The embodiment from FIG. 5 differs in regard to the embodiment according to FIGS. 1 and 2 in that a first section 32*c* of the impingement tube 16*c* extends in span wise direction 36 completely through a first cooling chamber 24 from a first or an outer platform 20 to a first cover plate 30 and completely through a second cooling chamber 24' from a second or inner platform 20' to a second cover plate 30'. Furthermore, the first section 32*c* ends at both its radial or longitudinal ends 66, 66' at the first and second cover plate 30, 30' in a hermetically sealed manner. The turbine assembly 10*c* is cooled by a first stream 56 of cooling medium 52 which is fed to the first section 32*c* from both radial or longitudinal ends 66, 66' and by a second stream 58 which is fed first to the first and second cooling chambers 24, 24' and thereafter to the second section 34*c* in series.

Figure 6:
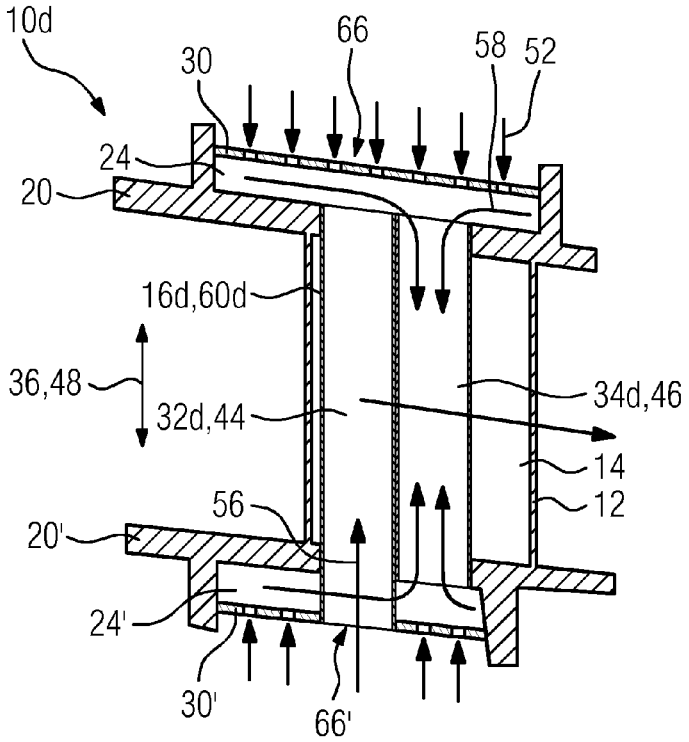
FIG. 6: shows a cross section through a third alternative turbine assembly with a further alternatively embodied impingement tube.

FIG. 6 depicts a cross section through a turbine assembly 10*d* analogously formed as in FIGS. 1 and 2 with an alternatively arranged impingement tube 16*d*. The embodiment from FIG. 6 differs in regard to the embodiment according to FIGS. 1 and 2 in that a first section 32*d* of the impingement tube 16*d* extends in span wise direction 36 completely through a second cooling chamber 24' from a second platform 20' to a second cover plate 30'. Thus, the first section 32*d* ends at its second radial or longitudinal end 66' at the second cover plate 30' in a hermetically sealed manner. The first section 32*d* and a second section 34*d* of the impingement tube 16*d* both extend through the outer platform 20 and terminate at their first radial or longitudinal ends 66 at the outer platform 20 and specifically in radial direction 48 flush with each other. A first radial or longitudinal end 66 of the first section 32*d* is sealed via a sealing means in respect to the first cooling chamber 24.

Figure 7:
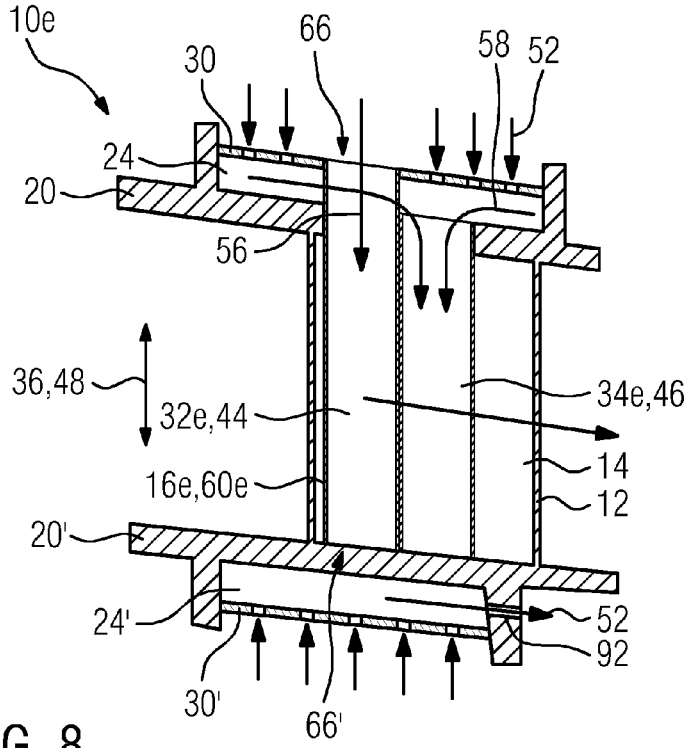
FIG. 7: shows a cross section through a forth alternative turbine assembly with a further alternatively embodied impingement tube

FIG. 7 shows a cross section through a turbine assembly 10*e* analogously formed as in FIGS. 1 and 2 with an alternatively embodied impingement tube 16*e*. The embodiment from FIG. 7 differs in regard to the embodiment according to FIGS. 1 and 2 in that a first section 32*e* and a second section 34*e* of the impingement tube 16*e* terminate on the aerofoil side of an inner platform 20', specifically in radial direction 48 flush with each other. Consequently, their second radial or longitudinal ends 66' do not extend through the inner platform 20' and the inner platform 20' seals the first and second sections 32*e*, 34*e* or their second radial or longitudinal ends 66', respectively. Hence, cooling medium 52 entering a second cooling chamber 24' of the inner platform 20' is not fed to the second section 34*e*. To provide an outlet for the cooling medium 52 to exit the second cooling chamber 24' it is provided with an exit aperture 92.

Figure 8:
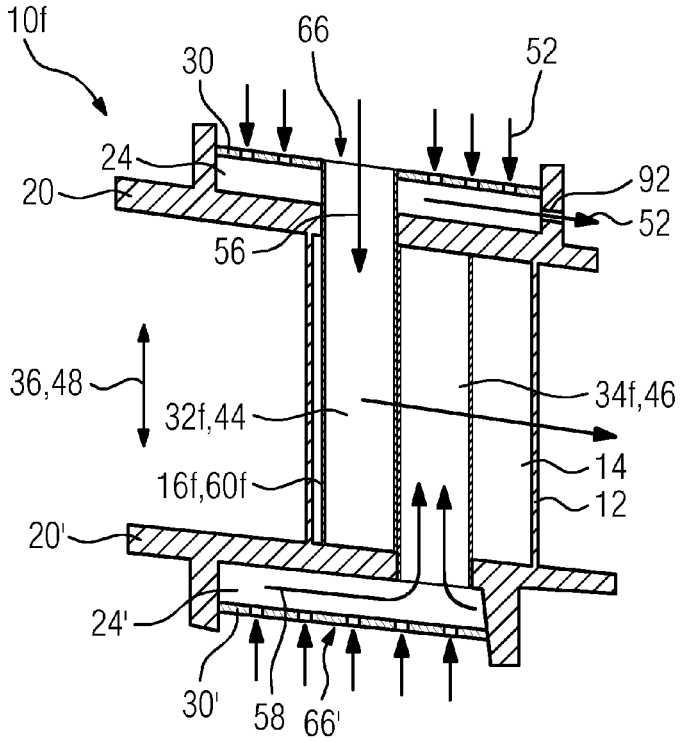
FIG. 8: shows a cross section through a fifth alternative turbine assembly with a further alternatively embodied impingement tube.

In FIG. 8 a cross section through a turbine assembly 10*f* analogously formed as in FIGS. 1 and 2 with an alternatively embodied impingement tube 16*f* is shown. The embodiment from FIG. 8 differs in regard to the embodiment according to FIGS. 1 and 2 in that a first section 32*f* of the impingement tube 16*f* terminates on the aerofoil side of an inner platform 20', thus its second radial or longitudinal end 66' does not extend through the inner platform 20' and the inner platform 20' seals the first section 32*f* or its second radial or longitudinal end 66', respectively. Moreover, a second section 34*f* terminates on the aerofoil side of an outer platform 20, hence its first radial or longitudinal end 66 does not extend through the outer platform 20 and the outer platform 20 seals the second section 34*f* or its first radial or longitudinal end 66. Thus, cooling medium 52 entering a first cooling chamber 24 of the outer platform 20 is not fed to the second section 34*f*. To provide an outlet for the cooling medium 52 to exit the first cooling chamber 24 it is provided with an exit aperture 92.

The described embodiments of the impingement tubes 16*c*, 16*d*, 16*e*, 16*f* or their base bodies 60*c*, 60*d*, 60*e*, 60*f* in FIGS. 5 to 8 could be embodied each as an one piece tube with two sections 32*c*, 32*d*, 32*e*, 32*f*, 34*c*, 34*d*, 34*e*, 34*f* or as a device with two separate pieces 44, 46.

It has to be noted that "radial" direction is meant as a direction—once the turbine assembly is integrated in a gas turbine engine with a rotational axis about which rotating parts revolve—which is perpendicular to the rotational axis and radial to this rotational axis.

The invention is particularly advantageous once two separate impingement tubes are inserted into the hollow vane which can be separately installed. Furthermore it is advantageous if different cooling fluid feed is provided to the separate impingement tubes. Particularly the feed of a rear impingement tube may be a provided such that the rear impingement tube will also pierce through an impingement plate present parallel to the platform for cooling of the back side of the platform. Furthermore, particularly the feed of a front impingement tube may be a provided such that the front impingement tube will not pierce through an impingement plate present parallel to the platform for cooling of the back side of the platform. The front impingement tube may particularly start and/or end in a cavity built by the impingement plate of the platform and a back side surface of the platform.

In a further embodiment the rear impingement tube may be exchanged by a plurality of rear impingement tubes.

Although the invention is illustrated and described in detail by the preferred embodiments, the invention is not limited by the examples disclosed, and other variations can be derived therefrom by a person skilled in the art without departing from the scope of the invention.

The invention claimed is:

1. A turbine assembly comprising:

an aerofoil extending in a radial direction from a platform;

an impingement tube extending in the radial direction through a cavity formed in the aerofoil, the impingement tube comprising a leading piece located toward a leading edge of the aerofoil and a trailing piece located toward a trailing edge of the aerofoil;

a platform cooling chamber;

a first cooling medium flow path arranged to direct a first cooling medium into the leading piece; and a second cooling medium flow path arranged to direct a second cooling medium into the trailing piece upon exiting the platform cooling chamber;

wherein the aerofoil extends in the radial direction between an inner platform and an outer platform, and wherein the turbine assembly comprises both an inner platform cooling chamber and an outer platform cooling chamber, and further comprising:

the second cooling medium flow path is arranged to direct a first portion of the second cooling medium through the inner platform cooling chamber then into the trailing piece and a second portion of the second cooling medium through the outer platform cooling chamber then into the trailing piece.

2. The turbine assembly according to claim 1, wherein the leading piece of the impingement tube ends at the cover plate in a hermetically sealed manner.

3. The turbine assembly according to claim 1, wherein the impingement tube extends substantially completely through a span of the aerofoil.

4. The turbine assembly according to claim 1, wherein the leading piece and the trailing piece of the impingement tube both terminate at the inner platform.

5. The turbine assembly according to claim 4, wherein the leading piece and the trailing piece of the impingement tube both terminate at the inner platform in a radial direction flush with each other.

6. The turbine assembly according to claim 1, wherein the trailing edge has exit apertures to allow cooling medium to exit the aerofoil.

7. The turbine assembly according to claim 1, wherein the aerofoil is a turbine blade or vane.

8. The turbine assembly according to claim 1 wherein the leading piece and the trailing piece are arranged side by side in an axial direction.

9. A gas turbine engine comprising a plurality of turbine assemblies, wherein at least one of the turbine assemblies is arranged according to claim 1.

10. The turbine assembly of claim 1, further comprising an aperture formed in the leading piece and a corresponding aperture formed in the trailing piece operable to allow a flow communication of cooling medium between the leading and trailing pieces.

11. The turbine assembly of claim 1, further comprising:

the leading piece extends at its respective radial ends through the inner platform cooling chamber and the outer platform cooling chamber, and the first cooling medium flow path comprises a respective inlet for the first cooling medium at each radial end of the leading piece.

12. The turbine assembly of claim 1, further comprising:

the leading piece extends at one end through one of the inner platform cooling chamber and the outer platform cooling chamber; and the first cooling medium flow path comprises an inlet for the first cooling medium at the one end of the leading piece.

13. The turbine assembly of claim 1, wherein the leading piece extends at an inner radial end through the inner platform cooling chamber; and the first cooling medium flow path comprises an inlet for the first cooling medium at the inner radial end of the leading piece.

14. The turbine assembly of claim 1, wherein the leading piece extends at its respective inner and outer radial ends through the respective inner and outer platform cooling chambers; and the first cooling medium flow path comprises an inlet for the first cooling medium at both the inner and outer radial ends of the leading piece.

15. A turbine assembly comprising:

an aerofoil comprising a first cavity;

an impingement tube inserted inside the first cavity for impingement cooling of an inner surface of the cavity;

a platform at a first radial end of the aerofoil;

a cooling chamber disposed on an opposed side of the platform relative to the aerofoil, the cooling chamber defined at a first radial end by the platform and at an opposed second radial end by a cover plate;

wherein the impingement tube comprises a leading piece and a trailing piece both being inserted in said first cavity, wherein the leading piece is located towards a leading edge of the aerofoil and the trailing piece is located towards a trailing edge of the aerofoil; and wherein the leading piece of the impingement tube extends in a radial direction completely through the cooling chamber from the platform to the cover plate and wherein the trailing piece of the impingement tube terminates in the radial direction at the platform;

the turbine assembly arranged to be cooled by a first stream of cooling medium which is fed to the leading piece of the impingement tube and by a second stream of cooling medium which is fed first to the cooling chamber and thereafter to the trailing piece of the impingement tube in series.

16. The turbine assembly according to claim 15, further comprising a further platform at a second radial end of the aerofoil, and wherein the leading piece and the trailing piece of the impingement tube both terminate at the further platform.

17. The turbine assembly of claim 15, further comprising an aperture allowing a flow communication of cooling medium between the leading and trailing pieces.

* * * * *